US007963891B1

(12) United States Patent
Zeaman

(10) Patent No.: US 7,963,891 B1
(45) Date of Patent: Jun. 21, 2011

(54) LIFT ADAPTER

(76) Inventor: Christian M. Zeaman, Oklahoma City, OK (US)

( * ) Notice: Subject to any disclaimer, the term of this patent is extended or adjusted under 35 U.S.C. 154(b) by 0 days.

(21) Appl. No.: 12/658,878

(22) Filed: Feb. 17, 2010

(51) Int. Cl.
*A63B 21/078* (2006.01)
*A63B 21/072* (2006.01)

(52) U.S. Cl. ..... 482/104; 482/106

(58) Field of Classification Search ..... 482/106–108, 482/93, 124–125, 44, 49–50, 104
See application file for complete search history.

(56) References Cited

U.S. PATENT DOCUMENTS

| | | | | |
|---|---|---|---|---|
| 734,062 | A | 2/1903 | Harris | |
| 2,617,650 | A | 11/1952 | Landis | |
| 4,231,569 | A | 11/1980 | Rae | |
| 4,312,506 | A | 1/1982 | Brennan | |
| 4,360,198 | A * | 11/1982 | Waulters | 482/106 |
| 4,618,142 | A * | 10/1986 | Joseph, Jr. | 482/82 |
| 4,768,780 | A | 9/1988 | Hayes | |
| 5,651,758 | A * | 7/1997 | Cervantes | 482/93 |
| 5,836,858 | A * | 11/1998 | Sharff | 482/106 |
| 6,217,494 | B1 * | 4/2001 | Sandoval | 482/106 |
| 6,663,542 | B1 * | 12/2003 | Trabbic | 482/106 |
| 6,715,728 | B2 * | 4/2004 | Nielsen | 248/339 |
| 7,097,601 | B1 * | 8/2006 | Ronnow | 482/106 |
| 7,476,183 | B1 | 1/2009 | Chrest | |
| 2004/0005970 | A1 * | 1/2004 | Anderson | 482/108 |
| 2006/0105890 | A1 * | 5/2006 | Logue | 482/106 |

* cited by examiner

*Primary Examiner* — Fenn C Mathew
(74) *Attorney, Agent, or Firm* — Randal D. Homburg

(57) ABSTRACT

A handle adapter utilized with an exercise weight, a dumb bell or a heavy object provides an improved grip upon the exercise weight and positions the weight or heavy objects in a vertical position or in a linear alignment in relation to the hands throughout the exercise or work movement, reducing stress upon the wrist, cartilage, tendons ligaments and joints during movement of the weight during exercise and to improve isolation upon the muscles while reducing the possibility of injury to the effected joints of the hands, arms and shoulders.

2 Claims, 4 Drawing Sheets

LIFT ADAPTER

CROSS REFERENCE TO RELATED APPLICATIONS

None.

BACKGROUND OF THE INVENTION

1. Field of Invention

A handle adapter utilized with an exercise weight, a dumb bell or a heavy object provides an improved grip upon the exercise weight and positions the weight or heavy objects in a vertical position or in a linear alignment in relation to the hands throughout the exercise or work movement, reducing stress upon the wrist, cartilage, tendons ligaments and joints during movement of the weight during exercise and to improve isolation upon the muscles while reducing the possibility of injury to the effected joints of the hands, arms and shoulders.

2. Description of Prior Art

A preliminary review of prior art patents was conducted by the applicant which reveal prior art patents in a similar field or having similar use, more specifically for the purpose of exercising the forearms and upper body. However, the prior art inventions do not disclose the same or similar elements as the present adapter apparatus, nor do they present the material components in a manner contemplated or anticipated in the prior art.

An early dumb bell, disclosed in U.S. Pat. No. 734,062 to Harris, provides a hand weight having a supplemental handle with a modified grip to permit a firmer and more vigorous grasp of the hand and to vary the position of the fingers. In U.S. Pat. No. 4,768,780 to Hayes, a sliding handgrip is positioned within a C-shaped handle, with the upper portion of the C-shaped handle having a pad, with the purpose of this hand grasp device to provide for the user to grasp the sliding handle in a palms down position with the pad resting against the back of the hand, to reduce the stress on the user's grasp during palms down exercise movements. It is provided to relieve stress on the fingers and thumb during this particular type exercise movement.

A modified type handle is incorporated into a hand held weight device forming a frame member with two end portions and an intermediate portion to receive a weight member with a rotating handle with the intermediate portion resting against a forearm to isolate the biceps brachii muscle in the arm during standing biceps curls for enhanced torque force trained to the particular muscle. The arm engaging surface on the intermediate portion of the frame member in the above device is the essential aspect of this weight bearing frame, disclosed in U.S. Pat. No. 4,231,569 to Rae. In U.S. Pat. No. 2,617,650 to Landis, a frame to which weights can be added for arm strengthening exercises includes a handle at a first end of two parallel side support with a ring on the second end, the ring sliding over the forearm with the handle being gripped by the hand, with weights being added an a bar which is perpendicular to the two side supports.

A device having a T-shaped bar attaches to a pivotal weight bar to which weights can be applied in U.S. Pat. No. 7,476,183 to Chrest. A palms up exercising device, disclosed in U.S. Pat. No. 4,312,506 to Brennan, discloses a cushioned, weight-distributing plate which has a hand grip rod laterally offset from, but parallel to, a pair of longitudinally spaced, weight-supporting rods, each projecting from an opposite end of the plate, intended to avoid pronation of the wrist when performing the palms up, supine curling exercises without undue and prolonged wrist strain.

SUMMARY OF THE INVENTION

Arm exercises commonly use a dumb bell weight to isolate the exercise to a single arm, focusing on the development of biceps brachii muscles as well as other muscles in the arm. The current weights generally require a firm grip on a handle throughout the exercise process. This has been known to create a large amount of stress on the wrist during, for example, a curl exercise. It is even more difficult when the curl is performed in a palms-down position, where the grip and the forward position of the dumb bell or weight increases the torque on the grip during the elevation of the dumb bell or weight. This stress on arms, hands and shoulders and their affected joints is also present in a work environment, where heavy objects are moved using primarily the arms, hands and shoulders During other dumb bell exercises, including those where the user lays on their back and performs single or double hand exercises with the weights, including butterfly or chest expansion exercises, the stress upon the grip and wrist of the user is also recognized. Standing trapezoid muscles exercises, where the weight are lifted from the users side to a full arm extension, also create noticeable stress on the grip, wrist and even the elbows. The present adapter may not be as recommended for palms-up exercises, because during a heavy or quick lift, the dumb bell may swing into the forearm and cause damage to the forearm, especially where the weight is quite heavy. However, in palms-down exercises, such as lateral side, lateral front or lying on the back doing lateral exercises, this adapter is most recommended. In industrial or work application, workers are instructed to use a palms-down grip and also where emphasis is made to use the legs or back muscles to perform the lift, as most safety directors would encourage a worker to do, the adapter would aid in the lift, because it would orient the heavy object in a linear direction along the line of force being applied and thus maximize the force while significantly reducing the stress on the hand, arm and shoulder and reduce the propensity to bend the joint to perform the lifting activity. Using the adapter also reduces the risk of being cut or receiving a splinter in the hand during a lift.

The current weight adapter is used with either a single hand weight, such as a dumb bell, or with a longer bar which requires a two handed grasp. The adapter may include an adjustable width bar retainer or shaped hooks which cradle the bar.

The most significant feature, however, is provided in the handle grip area, which provides a rigid and sturdy bar covered by a sleeve, which allows the bar to roll within the sleeve. The sleeve may be provided with an enhanced outer grip, a padded outer grip, a contoured outer grip or other included means which allows for the user to grasp the sleeve, yet provides the sleeve to roll around the bar with little if any friction to restrict the bar's ability to roll within the sleeve.

When lifting a heavy object or exercise weight using the adapter, the weight is positioned directly below the grip area and is always oriented in a vertical plane below the grip. This rotating grip eliminates or reduces much of the stress on the wrist caused by the torque incurred upon the wrist by the weight not being directed below the grip throughout the movement caused by the grip having to remain firm upon the bar which does not allow rotation of the objects being pulled or lifted. The weight force remains straight down throughout the movements of exercise or adjusts down the line of linear force being applied upon the adapter by the user. This also reduces the amount of swinging or jerking movement during the exercise, providing a more smooth movement flow during the lifting. It also isolates the stress on the muscles as opposed to the bone joints, increasing the efficiency of the exercise while reducing the potential for injury or joint fatigue of the tendons, ligaments and cartilage in the joints.

DESCRIPTION OF THE DRAWINGS

The following drawings are submitted with this utility patent application.

FIG. 5 is an exploded view of the components parts of the lift adapter in the embodiment demonstrating the expandable hook portion.

DESCRIPTION OF THE PREFERRED EMBODIMENT

Figure 7:
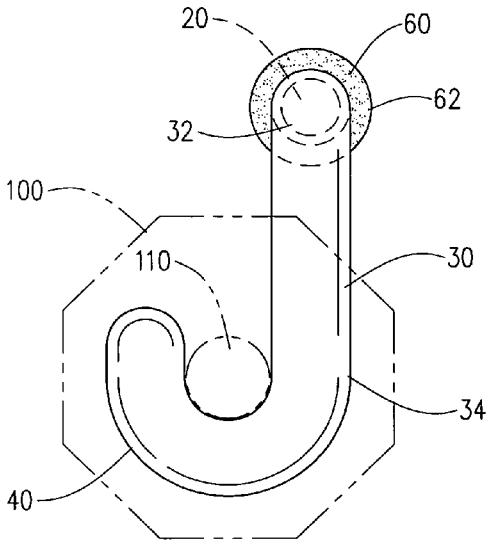
FIG. 7 is a side view of a lift adapter having a curved hook portion, with phantom lines indicating the placement of a dumb bell weight.
Figure 8:
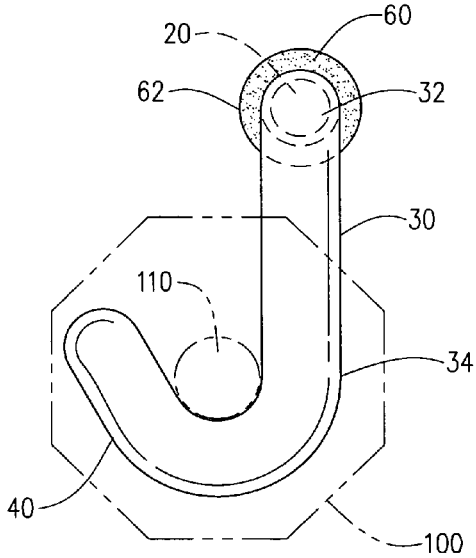
FIG. 8 is a side view of a lift adapter having an angled hook portion, with phantom lines indicating the placement of a dumb bell weight.

A lifting adapter 10 is used with an exercise weight 100 or other heavy object having a horizontally grip bar 110, handle or strap grasped by hand, shown in various embodiments in FIGS. 1-8 of the drawings as applied to an exercise weight, the adapter 10 comprising a horizontal bar member 20 having a smooth outer surface 22 and defining a first and second end 24, 26, each first and second end 24, 26 attaching an upper end 32 of an arm 30, the arm 30 further having a lower end 34 defining a grip bar retaining hook 40, and a grip sleeve 60 surrounding the outer surface 22 of the bar member 20 and loosely engaging the outer surface 22 to allow for rotation of the sleeve 60 around the bar member 20. The bar retaining hook 40 may be directly attached to the second end 34 forming an angle hook, as indicated in FIG. 8, a curved hook, as indicated in FIG. 7, an expandable hook, as indicated in FIGS. 1-3 and 5, or any other embodiment which will securely retain the grip bar 110, handle or strap of the exercise weight 100 or other heavy object throughout movement. The bar member 20 and the arms 30 may be attached together as separate components, as indicated in FIG. 5, or they may be integrates as a singular molded component, not shown.

The adapter is also intended for application in a work environment, where heavy objects are used or lifted. The adapter may be attached by securing the bar retaining hook to any handle, strap or other secure location, with the pulling or lifting force applied to the object, causing the handle to rotated along the bar member to redirect the force applied upon the object into a linear direction, along the line of force, eliminating the need to bend the wrist, elbow or shoulder during the movement of the object.

For single arm exercise using a dumb bell or short exercise bar, one adapter 10 is attached to the grip bar 110 of the exercise weight 100 and the user grasps the grip sleeve 60 with either one hand or two hands close together. As the arm is moved, the grip sleeve 60 freely rotates around the horizontal bar member 20, directing the force of the exercise weight in a straight vertical direction, no matter where the weight is held. In a double arm exercise using a longer weight bar, two adapters 10 are attached to the grip bar 110 of the exercise weight 100 with one hand grasping each adapter 10. As the arms are moved, the grip sleeves 60 freely rotate around the horizontal bar members 20 directing the force of the exercise weight in a straight vertical direction. Rotational torque incurred during movement of the exercise weight without the adapter is eliminated or significantly reduced during movement of the exercise weight using the adapter, reducing stress on the wrist, bone joints, tendons and ligaments of the arm. Thus, by using the adapter 10, greater repetition and possibly greater weight can be used during exercise, with more focus being directed to strengthening muscles in the exercise muscle groups being worked, as opposed to potentially damaging the joints, bones, ligaments, tendons and cartilage of the arms and shoulders.

The expandable hook embodiment of the retaining hook 40, shown in FIGS. 1-3 and 5, further comprises a first expansion member 42 extending from the lower end 34 of each arm 30 upon which an expansion opening 45 within a second expansion member 44 is slidably engaged, the second expansion member 44 further defining and upward retaining projection 47, each first expansion member 42 and second expansion member 44 having a plurality of axially aligned holes 43, 46 which are aligned and maintained at a preferred width dependant upon the diameter of the grip bar 110 of the exercise weight 100 cradled within the expandable hook 40, the first and second expansion members 42, 44 held in place by a locking pin 50 inserted through the axially aligned holes 43, 46. The first expansion member 42 and second expansion member 44 may also have a threaded engagement as well as the slidable engagement. Additionally, the upward retaining projection 47 may also have a friction enhancing lining, not shown, to prevent rotation of grip bar within the expandable hook.

Figure 1:
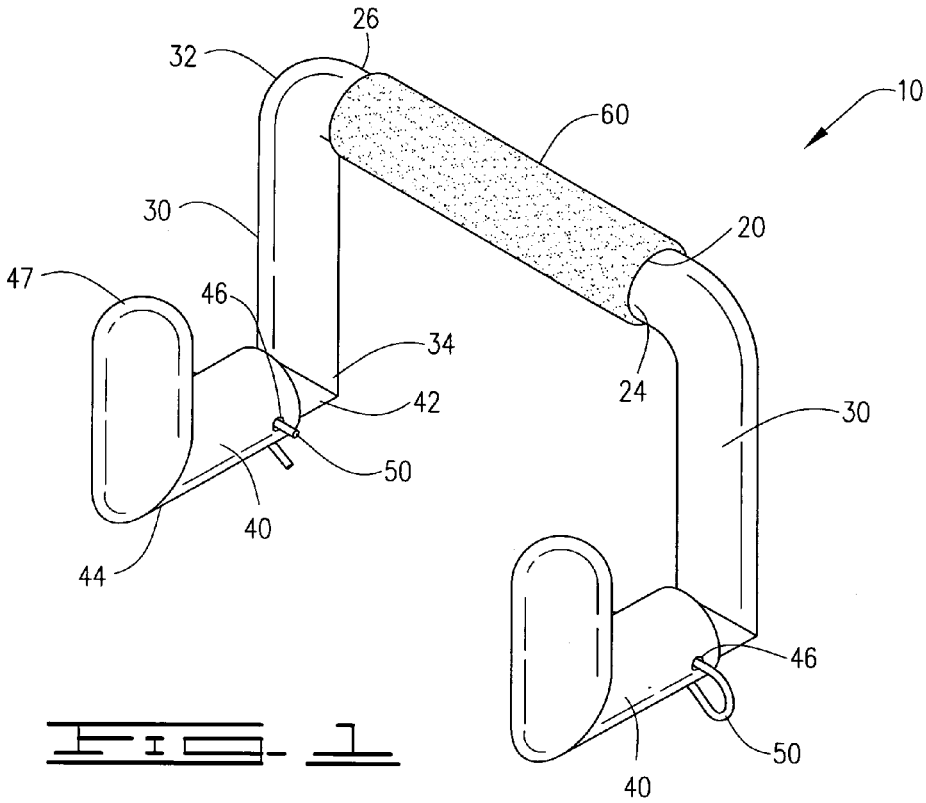
FIG. 1 is a perspective view of the lift adapter in an embodiment demonstrating an expandable hook portion.
Figure 2:
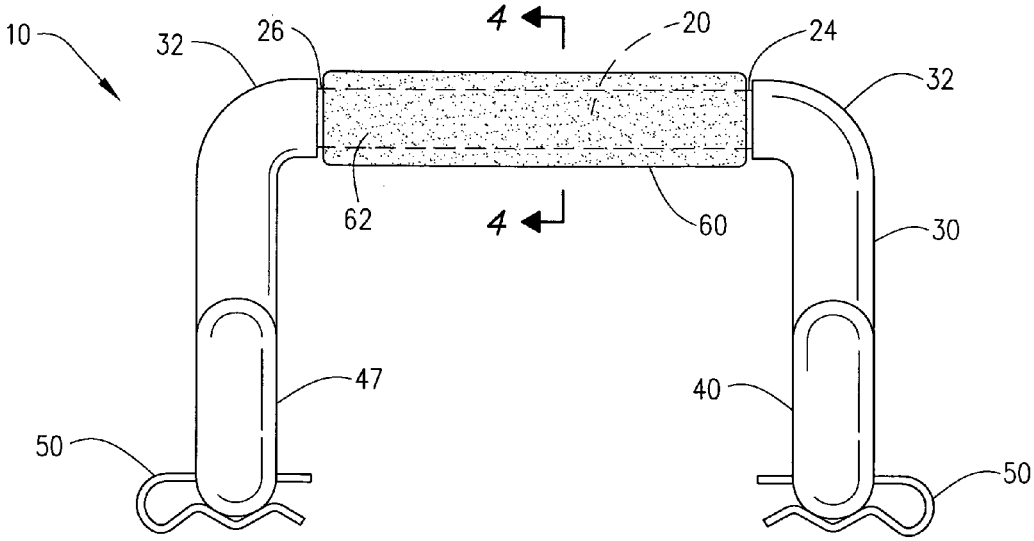
FIG. 2 is a front view of the lift adapter in the embodiment demonstrating the expandable hook portion.
Figure 3:
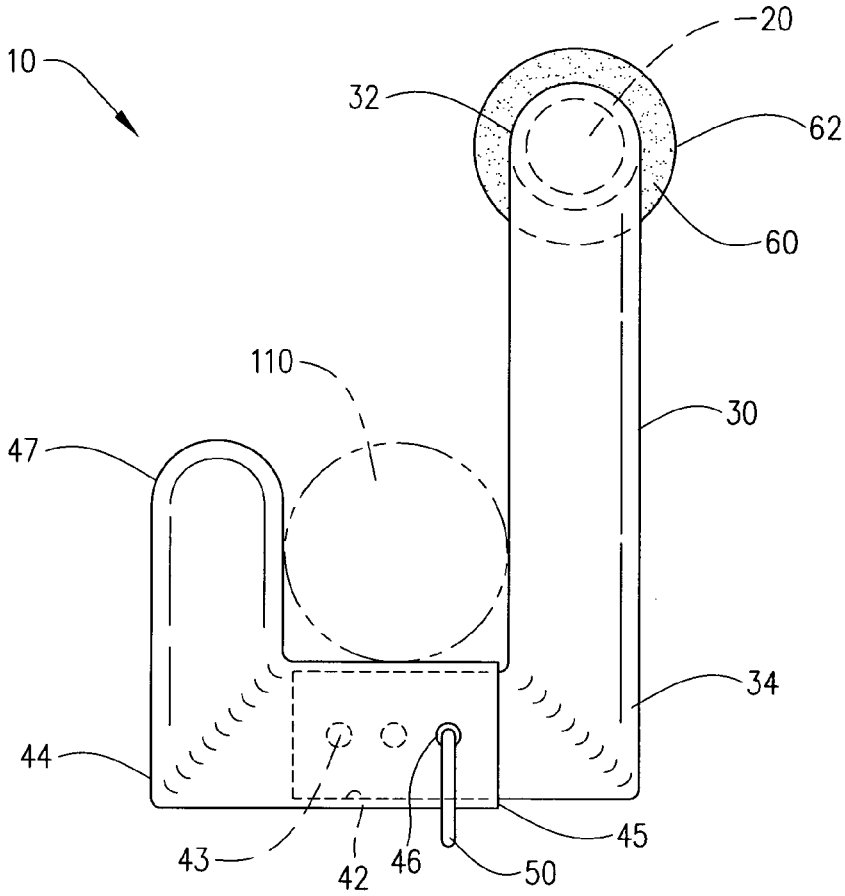
FIG. 3 is a side view of the lift adapter in an embodiment demonstrating the expandable hook portion with phantom lines indicating a weight bar and broken lines indicating components obscured by solid structures
Figure 4:
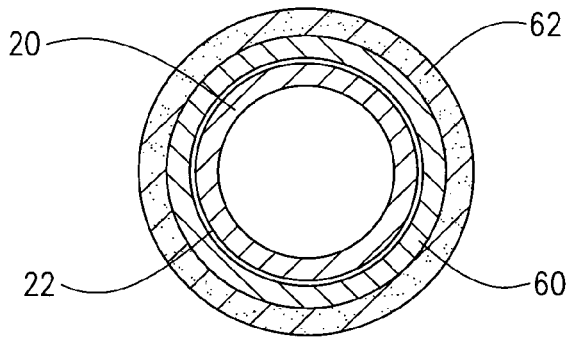
FIG. 4 is a cross sectional view of the handle portion of the lift adapter, along section lines 4/4 of FIG. 2.
Figure 3:
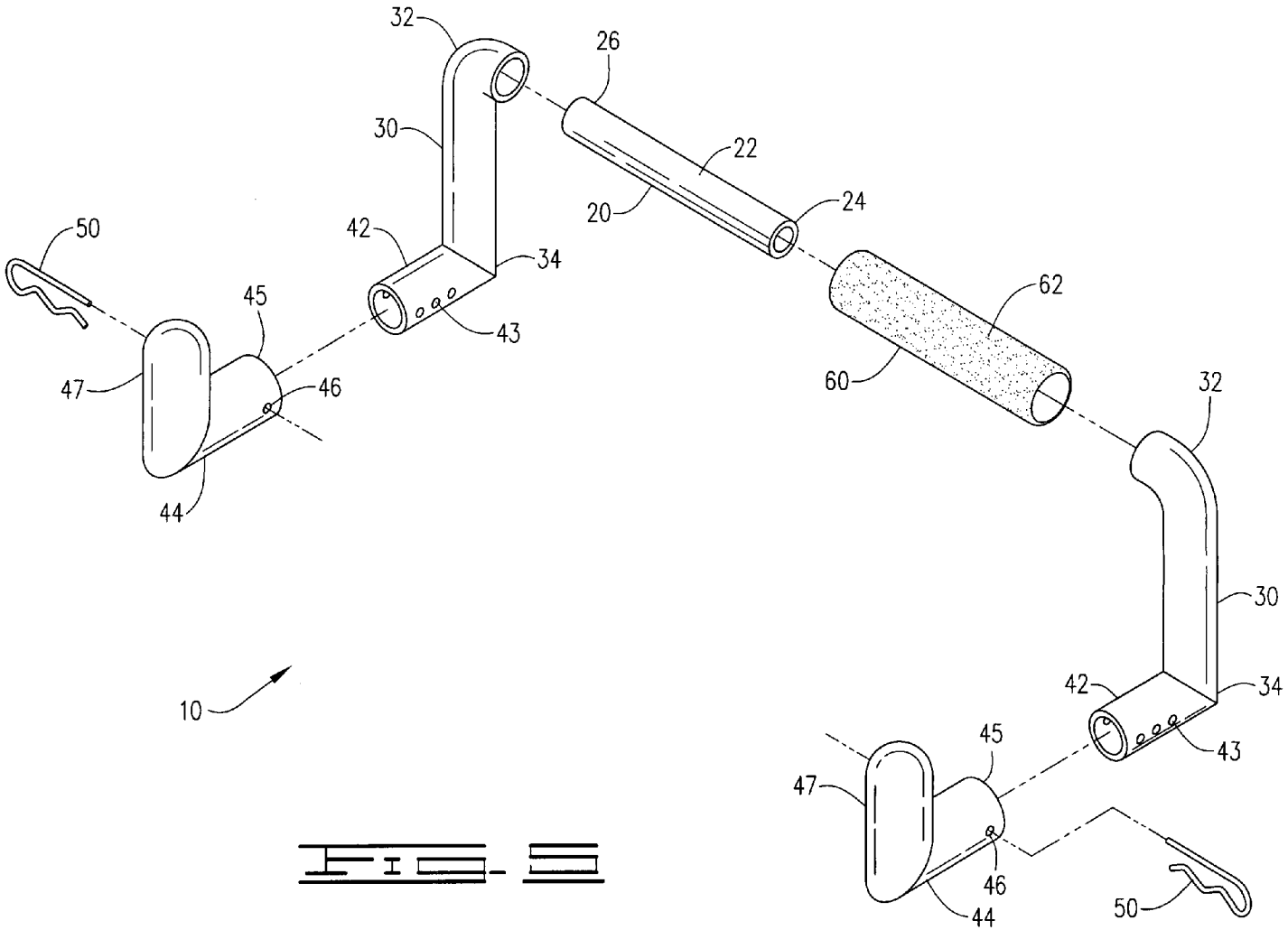
Figure 6:
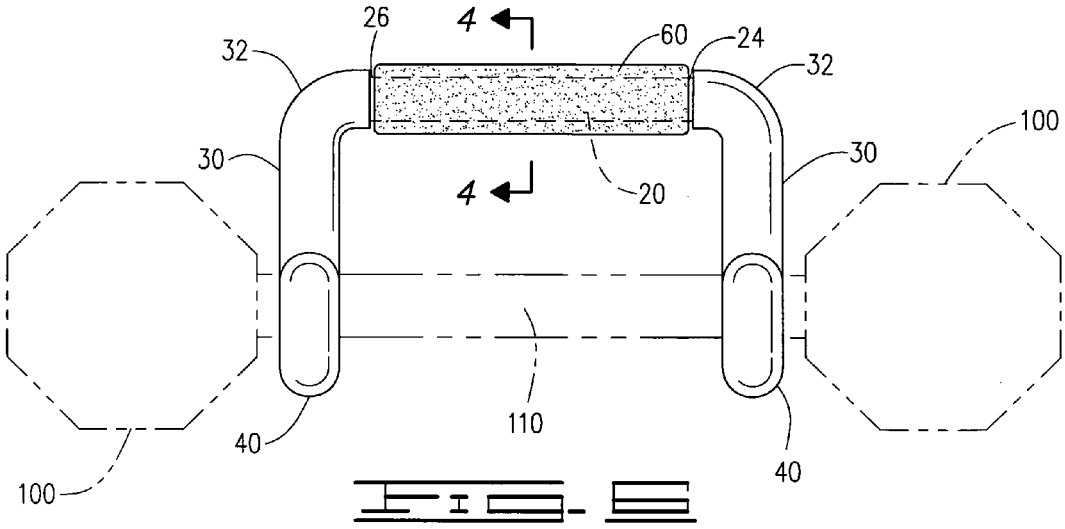
FIG. 6 is a front view of another embodiment of the lift adapter, with phantom lines indicating the placement of a dumb bell weight.

The grip sleeve 60 may further define a padded outer surface 62, as indicated in FIG. 4, which should provide greater comfort to the user's hand and also offer an enhanced grasp of the sleeve by the user's hand. This padded outer surface 62 may be provided by a fabric, foam or gel foam material. It should be durable so that it may be used with great weight and with repeated use without becoming worn or damaged.

While the invention has been particularly shown and described with reference to a preferred embodiment thereof, it will be understood by those skilled in the art that changes in form and detail may be made therein without departing from the spirit and scope of the invention.

What is claimed is:

1. A lifting adapter used with an exercise weight or other heavy object having a horizontally grip bar, handle or strap grasped by hand, said adapter comprising:

a horizontal bar member having a smooth outer surface and defining a first and second end, each said first and second end attaching an upper end of an arm, each said arm further having a lower end defining a grip bar retaining hook, said grip bar retaining hook further comprising a first expansion member extending from said lower end of each said arm and a second expansion member defining an expansion opening within which said first expansion member is slidably engaged, said second expansion member further defining and upward retaining projection, each first expansion member and second expansion member further providing a plurality of axially aligned holes which are aligned and maintained at selected width dependant upon the size of said grip bar, handle or strap of said weight or other object cradled within said expandable hook, said first and second expansion members held in place by a locking pin inserted through said axially aligned holes; and a grip sleeve surrounding said horizontal bar member and loosely engaging said horizontal bar to allow for rotation of said sleeve around said member, wherein said bar retaining hook securely retains said grip bar, handle or strap of said weight or object throughout exercise movement or applied force, said grip sleeve freely rotating around said horizontal bar member, positioning a direction of force of said weight in a straight downward vertical direction or adjusting the direction according to the linear direction of applied force, no matter what position said weight or object may be during arm movement, reducing stress on the hands, wrist, bone joints, tendons and ligaments of the arm and shoulders.

2. A lifting adapter used with an exercise weight or other heavy object having a horizontally grip bar, handle or strap grasped by hand, said adapter ter comprising:

a horizontal bar member having a smooth outer surface and defining a first and second end, each said first and second end attaching an upper end of an arm, each said arm further having a lower end defining a grip bar retaining hook, said grip bar retaining hook further comprising a first expansion member extending from said lower end of each said arm and a second expansion member defining an expansion opening within which said first expansion member is slidably engaged, said second expansion member further defining and upward retaining projection, each first expansion member and second expansion member further providing a plurality of axially aligned holes which are aligned and maintained at selected width dependant upon the size of said grip bar, handle or strap of said weight or other object cradled within said expandable hook, said first and second expansion members held in place by a locking pin inserted through said axially aligned holes; and a grip sleeve surrounding said horizontal bar member and loosely engaging said horizontal bar to allow for rotation of said sleeve around said member, said grip sleeve defining a padded outer surface providing greater comfort to the user's hand and also to enhance the grasp of the sleeve by the user's hand, wherein said bar retaining hook securely retains said grip bar, handle or strap of said weight or object throughout exercise movement or applied force, said grip sleeve freely rotating around said horizontal bar member, positioning a direction of force of said weight in a straight downward vertical direction or adjusting the direction according to the linear direction of applied force, no matter what position said weight or object may be during arm movement, reducing stress on the hands, wrist, bone joints, tendons and ligaments of the arm and shoulders.

* * * * *